US007243378B2

(12) United States Patent
Desarmaux et al.

(10) Patent No.: US 7,243,378 B2
(45) Date of Patent: Jul. 17, 2007

(54) MODULAR HELMET

(75) Inventors: Pierre Desarmaux, Evires (FR); Hervé Favre-Felix, Epagny (FR)

(73) Assignee: Salomon S.A., Metz-Tessy (FR)

( * ) Notice: Subject to any disclaimer, the term of this patent is extended or adjusted under 35 U.S.C. 154(b) by 80 days.

(21) Appl. No.: 11/002,290

(22) Filed: Dec. 3, 2004

(65) Prior Publication Data

US 2005/0120467 A1 Jun. 9, 2005

(30) Foreign Application Priority Data

Dec. 8, 2003 (FR) ..... 03 14352

(51) Int. Cl.
*A42B 1/08* (2006.01)

(52) U.S. Cl. ..... 2/423; 2/209; 2/425

(58) Field of Classification Search ..... 2/423, 2/209, 410, 422, 425, 12, 10, 424; 381/376; 379/430

See application file for complete search history.

(56) References Cited

U.S. PATENT DOCUMENTS

| | | | | | |
|---|---|---|---|---|---|
| 1,418,388 | A | * | 6/1922 | Miessner | 381/382 |
| 1,463,810 | A | * | 8/1923 | Gilson | 381/376 |
| 3,444,288 | A | * | 5/1969 | Mead | 264/161 |
| 3,500,475 | A | * | 3/1970 | Otsuka | 2/421 |
| 3,665,514 | A | * | 5/1972 | Durand | 2/420 |
| 4,259,747 | A | * | 4/1981 | Taesler et al. | 2/422 |
| 4,462,119 | A | * | 7/1984 | Rudd | 2/424 |
| 4,794,652 | A | | 1/1989 | Von Planta | |
| 4,918,752 | A | * | 4/1990 | Briggs | 2/6.2 |
| 5,376,318 | A | | 12/1994 | Ho | |
| 5,577,495 | A | * | 11/1996 | Murphy | 128/201.24 |
| 5,603,117 | A | * | 2/1997 | Hudner et al. | 2/6.6 |
| 5,621,923 | A | * | 4/1997 | Tapocik | 2/422 |
| 6,009,562 | A | * | 1/2000 | Bullock et al. | 2/422 |
| 6,352,383 | B1 | * | 3/2002 | Ristola | 403/254 |
| 6,546,264 | B1 | * | 4/2003 | Kennedy | 455/575.2 |
| 6,606,114 | B1 | * | 8/2003 | Gordon et al. | 348/64 |
| 6,804,829 | B2 | * | 10/2004 | Crye et al. | 2/6.6 |
| 7,051,732 | B2 | * | 5/2006 | Uusitalo et al. | 128/201.25 |
| 2002/0131616 | A1 | * | 9/2002 | Bronnikov et al. | 381/370 |

FOREIGN PATENT DOCUMENTS

| | | | |
|---|---|---|---|
| DE | 28 47 724 | A | 5/1980 |
| DE | 91 03 950 | U | 8/1992 |
| DE | 94 06 325 | U | 11/1995 |
| DE | 100 57 473 | A | 5/2002 |
| DE | 202 01 658 | U | 7/2003 |
| EP | 1 300 089 | A | 4/2003 |
| FR | 2 524-766 | A | 10/1983 |
| FR | 2629986 | A1 * | 10/1989 |

* cited by examiner

*Primary Examiner*—Rodney M. Lindsey
(74) *Attorney, Agent, or Firm*—Greenblum & Bernstein, P.L.C.

(57) ABSTRACT

A helmet for protecting the head having a rigid shell that includes a body, made of an expanded polystyrene type of material, for example, molded over an outer skin, the shell further including a rigid arch device, the arch device includes a headband applied to the shell, each of the ends of the headband being equipped with an ear-covering part. The ear-covering parts can include a foam cushion covered by fabric. The arch device can have two wings which cover the ear-covering parts and which extend the headband and which can also be provided with a chin guard joining the two wings together. The arch device can be either glued or releasably attached to the shell.

27 Claims, 7 Drawing Sheets

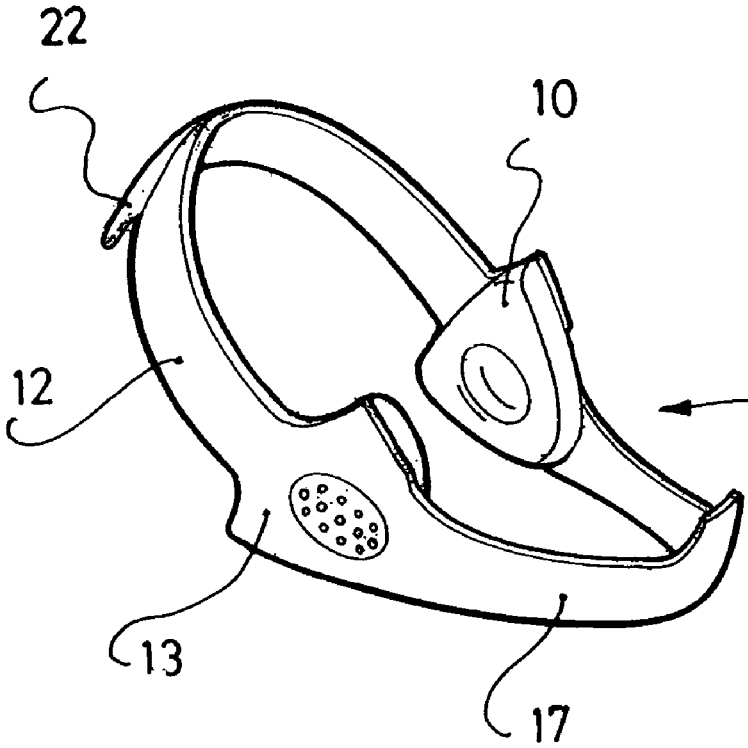
Fig: 7
Fig: 6
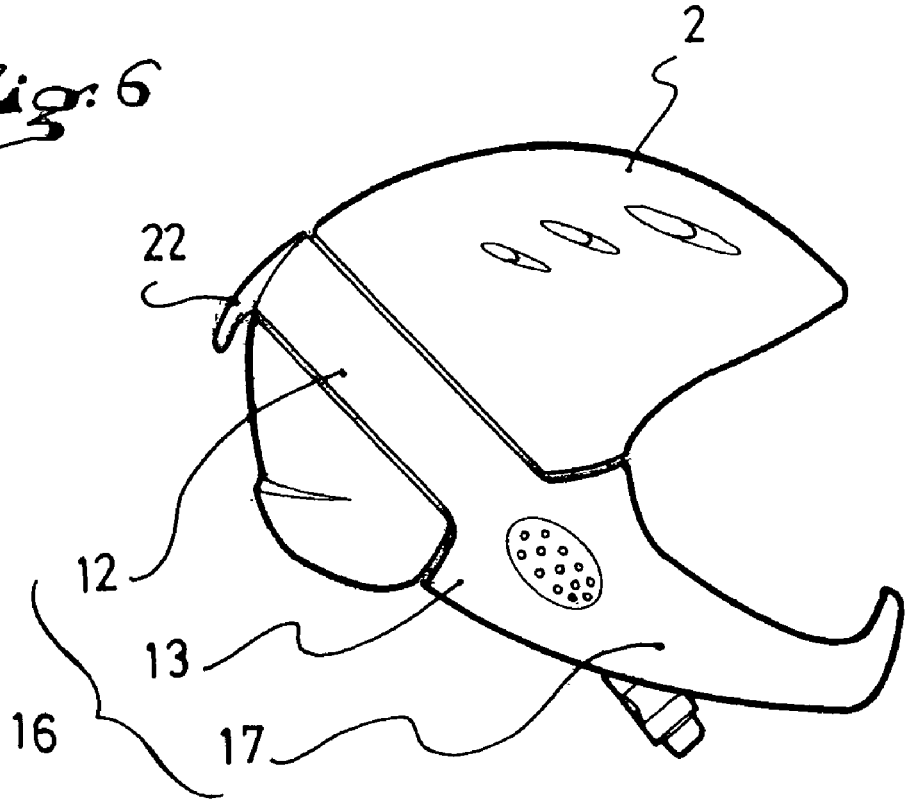

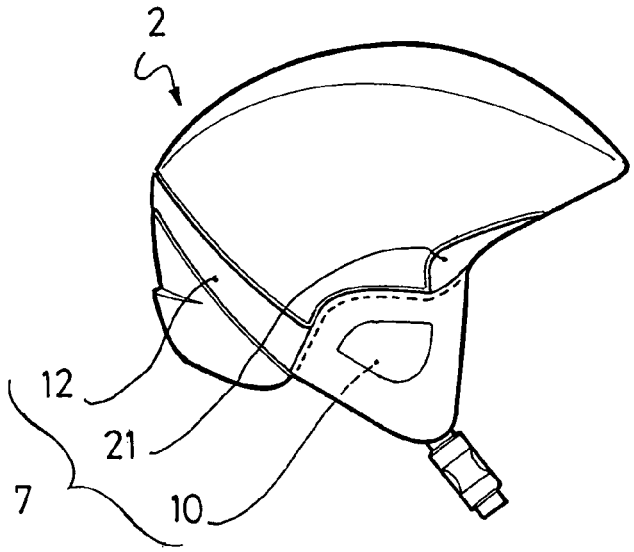
Fig: 11
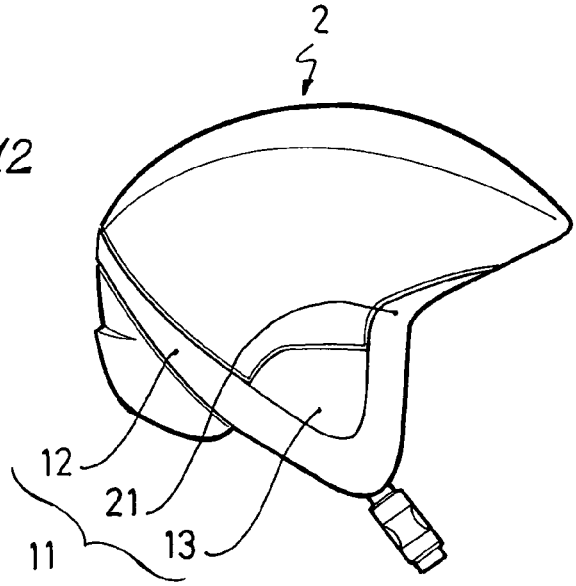
Fig: 12
Fig: 13
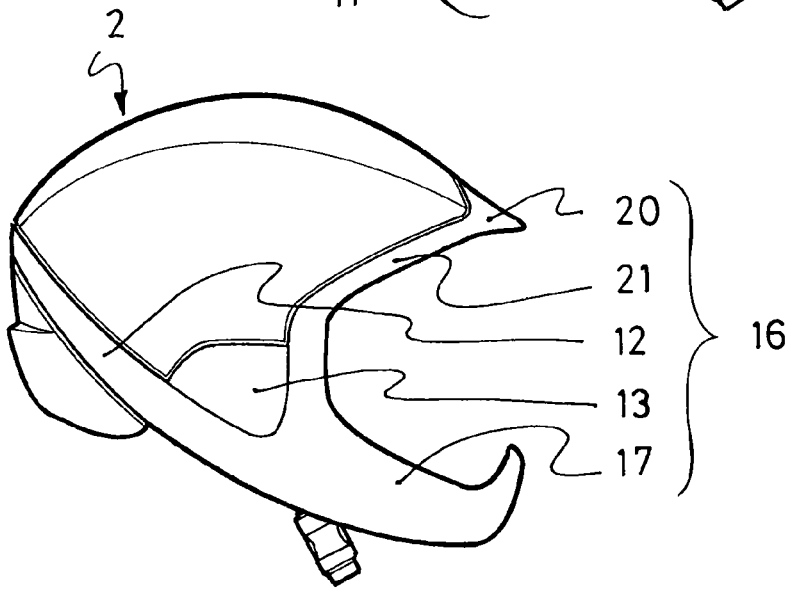

MODULAR HELMET

CROSS-REFERENCE TO RELATED APPLICATION

This application is based upon French Patent Application No. 03.14352, filed Dec. 8, 2003, the disclosure of which is hereby incorporated by reference thereto in its entirety and the priority of which is hereby claimed under 35 U.S.C. §119.

BACKGROUND OP THE INVENTION

1. Field of the Invention

The invention relates to helmets for protecting the user's head during sporting activities. In particular, the invention relates to helmets to be used for skiing, snowboarding, biking, skateboarding, roller-skating, kayaking, and other sports.

Such helmets are required in sports such as mountain biking, competitive skiing, speed skating or the so-called "aggressive" roller-skating, for example. In addition, the use of such helmets is also strongly recommended for leisure biking and skiing.

2. Description of Background and Relevant Information

Various techniques have been used in the past to manufacture helmets of the aforementioned type. A particular one of these techniques is widely used in the manufacture of motorcycle and motorbike helmets and in the manufacture of certain ski helmets. Specifically, a rigid and relatively thin shell or cap is made by injection (PC, ABS) or by any other appropriate means (for example, by layering of various resin-impregnated layers of fabric). The shell is then fitted with comfort and/or shock-absorbing elements having an under cap of an expanded polystyrene (EPS), foams, fabrics. This technique enables helmets to be manufactured with a closely fitting contour.

Typically, such a helmet can cover the user's entire skull and also the ears, even the user's jaw. Through this technique, it is easy to mass produce single-piece shells with a maximal head coverage, at reasonable cost. Indeed, after the injection of the shell, even when the latter has full coverage, the shell remains deformable to enable removal from the mold. The disadvantage of this technique is that helmets made in this manner are rather heavy. Yet the weight of a helmet is a determining factor not only in competition but also in leisure activities where the heavier the user feels the helmet is, the less likely he/she is to wear it.

Another manufacturing technique is called "in-mold". In this technique, most of the helmet is made in the same mold. Once the helmet is removed from the mold, it is equipped with a chin strap, and possibly with a comfort lining and other accessories. In practice, the outer skin of the shell, referred to as a "microshell", is made independently. For example, this skin can be a polycarbonate sheet. This sheet is thermoformed so as to take the final shape of the outer surface of the helmet. This sheet is thin (generally, less than or equal to 1 millimeter). After trimming and cutting, the sheet is positioned in a mold with a polystyrene type material. The heat and the steam introduced in the mold trigger the expansion of the polystyrene until it fills up the volume of the mold and bonds with the polycarbonate sheet. Upon removal from the mold, the helmet is formed as a thick expanded polystyrene shell molded over an outer skin. Such a helmet has no flexibility and, therefore, unless expensive molds are used, this technique is only used to make lightweight helmets, the covering area of which does not include the zone covering the ears. For example, if one were to compare the covering area of a helmet to a sphere, it would be said that this technique prevents having a covering surface that cannot be contained in half a sphere. In practice, this technique is used for summer helmets having a shell that does not include parts for protecting the ears.

Another disadvantage of the so-called "in-mold" technology is that it is not possible to guarantee a precise positioning of the decorations on the helmet. The decoration is laid flat on the sheet that will be thermoformed, then placed in the mold with the polystyrene. During the thermoforming and the expansion phase of the polystyrene, it is very difficult to maintain the decoration lines intact, so that a line intended to be straight is blurred on the final helmet.

One technique used for decorating a helmet is to put a plurality of sheets in the mold, each of a different color. After the molding stage and the expansion of the polystyrene, the helmet has portions of its outer surface in different colors. This decoration technique also has its limits in terms of the quality of the finish because, in view of the imprecise positioning of the sheets in the mold, it is necessary to provide a substantial clearance (several millimeters) between the two sheets. On the finished product, the expanded polystyrene remains visible between the two colored sheets and the border between the two sheets is irregular.

SUMMARY OF THE INVENTION

An object of the invention is to provide a helmet which is manufactured without the above-mentioned disadvantages.

An additional object of the invention is also to provide a line of helmets for various uses, but which are less expensive to manufacture and develop, A further object of the invention is to provide a helmet that can be used in the practice of various sports.

These objects are achieved by a helmet that has a hard shell made of a material such as expanded polystyrene molded over an outer skin and having a rigid arch, or relatively rigid arch, the arch having a headband applied to the shell, and both ends of which are equipped with ear-covering parts.

These objects are also achieved by the invention in that various helmets in a line of helmets have in common an identical shell to which an additional distinguishing element, namely an arch, is added.

These objects are also achieved by providing a helmet that has a shell as well as a plurality of additional elements, each provided for using the helmet in a particular sporting activity or under specific weather conditions.

Advantageously, according to the invention, the rigid shell is made with the so-called "in-mold" technology, which permits the manufacture of a relatively lighter shell than the traditional manufacturing of an injected rigid shell.

BRIEF DESCRIPTION OF DRAWINGS

Other advantages will become apparent from the description that follows, with reference to the annexed drawings, in which:

FIG. 6 is a side view of a helmet according to a third embodiment of the invention FIG. 7 is a perspective view of the arch of the helmet of FIG. 6;

FIGS. 8–13 are variations of the additional and different embodiments of the invention.

DETAILED DESCRIPTION OF THE INVENTION

Figure 1:
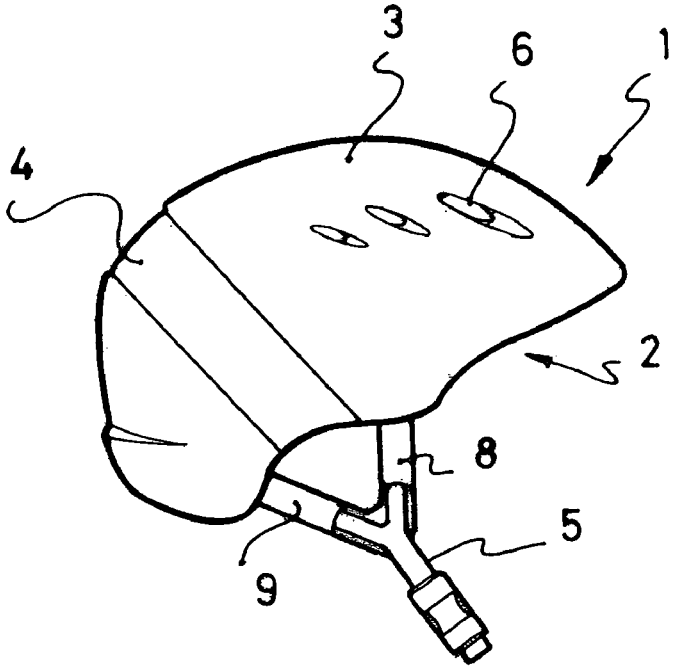
FIG. 1 is a side view of a shell of a helmet according to the invention.

FIG. 1 illustrates a helmet that has a shell 2 made with "in-mold" technology. In this particular embodiment, the shell 2 comprises a body, in the form of expanded polystyrene, or an expanded polystyrene type of material, molded over an outer skin 3. The outer skin 3, or "micro-shell", is provided with vents 6, in the form of through-holes, positioned in relation to openings provided in the polystyrene cap. These vents 6 allow fresh air to penetrate inside the helmet. The shell has a channel or groove 4 which runs along its outer surface from one side to the other, from the left temporal area to the right temporal area (shown in FIG. 1). This groove 4, which comprises a slight recess on the outer surface of the helmet, is adapted to receive the arch 7. The helmet is retained on the user's head by means of a chin strap 5 made of a series of flexible straps which have on each side of the helmet a front strap 8 and a back strap 9, which join together to form the chin strap itself. The internal lining of the helmet is not shown in FIG. 1, but is described below.

Figure 2:
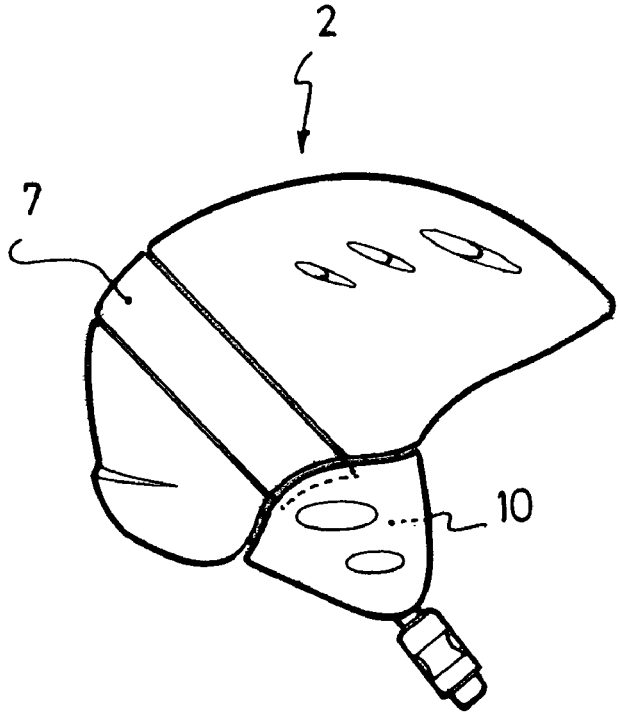
FIG. 2 is a side view of a helmet according to a first embodiment of the invention.

FIG. 2 shows the same helmet as in FIG. 1, to which an arch portion 7 has been attached. The arch portion 7 is imbedded in the groove 4 and it is fixed to the shell. Two ear-covering parts 10 are attached at the two ends of the arch. Only the part on the right side is shown in FIG. 2. The parts 10 can take various forms, such as, as shown in the figure, foam cushions covered by a fabric.

As can be shown in FIG. 2, as well as in FIGS. 3, 6, and 8–10 of other embodiments, the contours of the edges of the arch portion 7 are the same as the edges of the groove 4, thereby providing a close-fitting nesting of the arch portion 7 within the groove 4.

The arch can be attached to the shell by any appropriate means to provide either a permanent or a non-permanent attachment. For example, one can use glue, such as glue 25 (see FIG. 5*a*), or plastic rivets connected to inserts. The invention also encompasses an attachment that can be removed and repositioned by the user, for example by using screws connected to inserts or snap buttons so as to allow the user to wear the helmet with or without the ear-covering parts.

Figure 4:
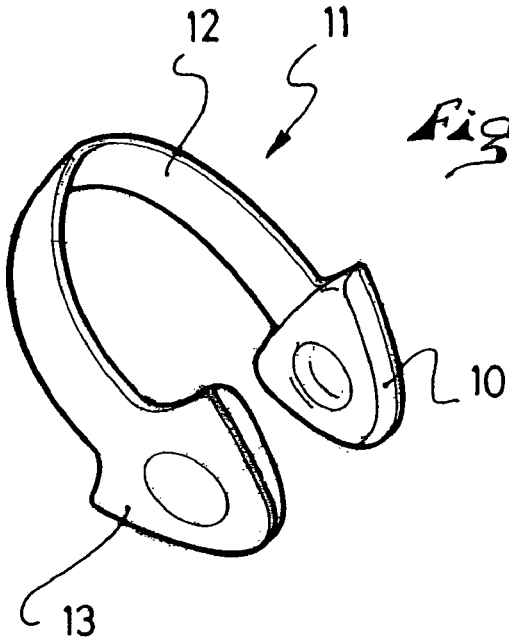
FIG. 4 is a perspective view of an arch of the helmet of FIG. 3.
Figure 3:
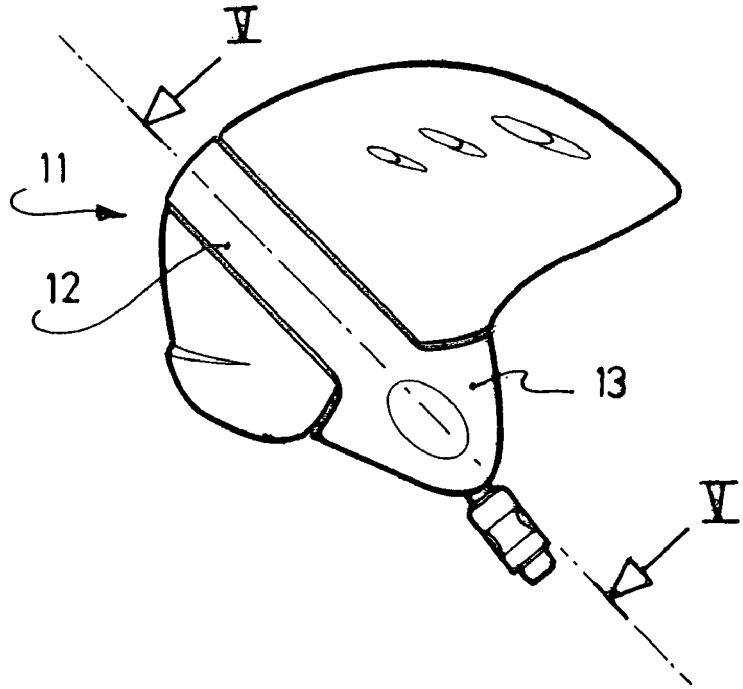
FIG. 3 is a side view of a helmet according to a second embodiment of the invention.

FIG. 3 shows a helmet with a shell identical to that of the helmet of FIG. 1. A arch 11 is nested in the groove 4. This device 11, referred hereinafter as an arch, an arch device, or an arch-ear device, is shown separately and in perspective in FIG. 4. The device 11 includes a portion in the shape of a headband 12, with wings 13 extending the headband at either end. The arch 11 is nested within the groove 4 inasmuch as the lengthwise-extending opposite edges of the arch 11 have the same contours as the lengthwise-extending opposed edges of the groove 4. In the example of FIG. 3, the contours of the opposite edges of headband portion 12 of the arch are shown to be straight. i.e., straight in the two-dimensional depiction of the drawing figure.

The headband portion 12 and the wings 13 can constitute a single piece made by injecting molding of a plastic material, for example. This last characteristic is not limiting, the invention encompassing making the device 11 in several parts which are assembled before or after the mounting on the shell, for example, as shown in FIG. 5*a*, the arch 11 can be comprised of a plurality of layers, such as layers 23. 24. In order to address aesthetic concerns, the device can be made by means of a two-color injection molding. In order to achieve lightness and performance, the layering of glass or carbon fabric can be used rather than plastic injection.

Figure 5:
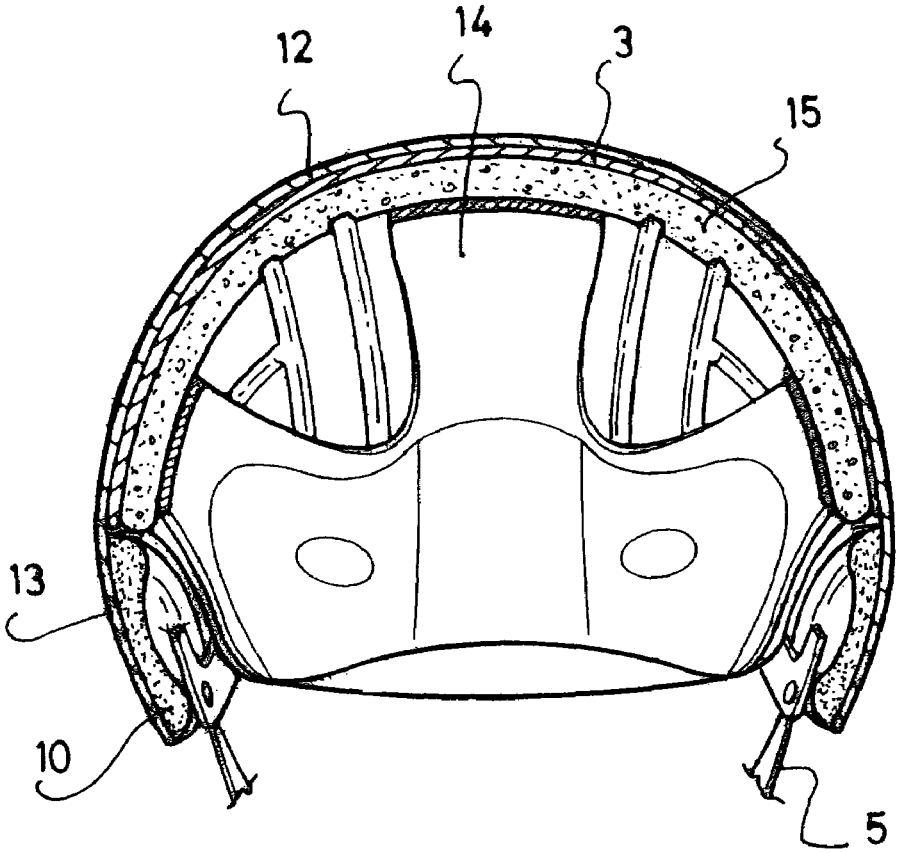
FIG. 5 is a cross-sectional view of the helmet, taken along line V—V of FIG. 3.
Figure 5A:
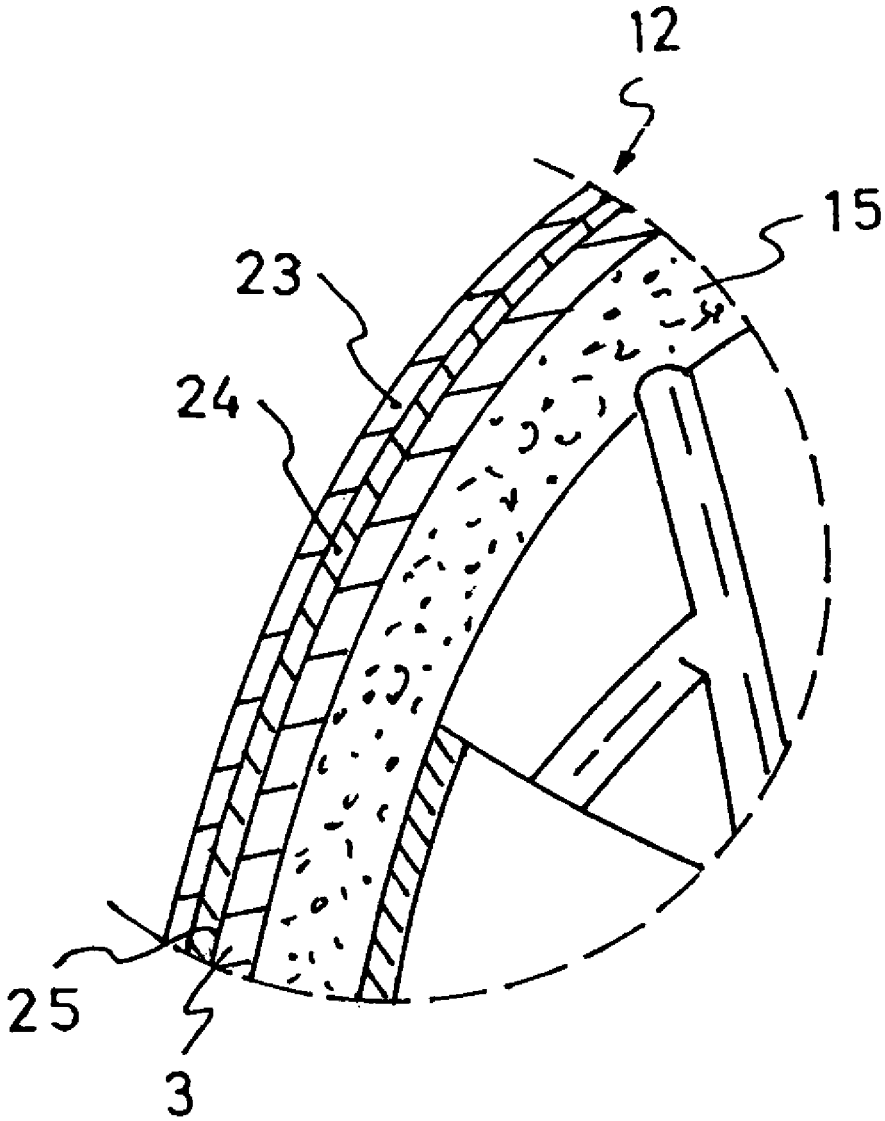
FIG. 5*a* is a view of an enlargement of a portion of FIG. 5.

FIG. 5 shows a cross-sectional view of the helmet illustrated in FIG. 3. The shell 2 includes a cap 15, made of polystyrene, e.g., covered by an outer skin 3. For the purpose of simplicity and enabling the invention to be best understood, the thicknesses of the various parts are not drawn to scale. Thus, the outer skin 3 indeed only has a thickness that is generally less than 1 millimeter. The arch-ear device 11 girdles the shell. The headband portion 12 is applied against the outer skin 3 and affixed thereto by any appropriate means, permanent or non-permanent. Beyond the headband portion 12, the arch extends into two wings 13 which are substantially tuned towards the internal volume of the helmet so as to ensure a better adjusted coverage of the head and in particular of the area of the ears. The headband portion 12 and wings 13 are a single piece. The ear-covering parts 10 are fixed on the wings 13. During the assembly of arch 11 on the shell 2, the arch is elastically deformed so as to space the wings 13 apart outward.

The helmet is further equipped with au inner lining 14 which is positioned inside the shell 2 so as to be in contact with the user's head. The function of the lining is to provide comfort and retain the shell in place on the head. The lining includes foam elements, which can be covered with fabric, and it is arranged in a fixed or removable manner inside the shell, for example by means of self-gripping straps, such as hook and loop fastening devices, such as VELCRO®.

FIG. 6 shows another helmet, the shell 2 of which is identical to that of the shells described above. This shell 2 is associated with an arch/chin guard device 16, the headband portion of which is nested in groove 4 provided in the outer skin 3 of the shell. The arch/chin guard device 16 is affixed to the outer skin 3, such as with glue.

The arch/chin guard device 16 is shown separately and in perspective in FIG. 7. The device 16 includes a headband portion 12, two wings 13, and a chin guard 17. The chin guard 17 protects the jaw and the face in higher risk sports such as downhill mountain biking. Ear-protecting devices made of foam cushion, possibly covered by fabric, are fixed in the area of the wings 13. The cushion substantially has an annular shape so that a cavity providing more comfort to the ears is created and also in order not to interfere with hearing. In addition, the wings 13 include a plurality of vents that extend through the wings to facilitate hearing.

The arch/chin guard device 16 can be provided as a unitary piece, made by injection molding, for example. Alternatively, the device 16 can be made from a plurality of parts that are assembled together. In order to position the device 16, it is necessary to deform it elastically by spacing the wings apart. In the case where the material selected to make the arch/chin guard device cannot be elastically deformed enough, the invention encompasses the headband portion 12 being split into two pieces. In the case of the former, and for the purpose of providing the device 16 easily removable or interchangable, the elasticity of the arch can be used to retain the arch in the groove 4 once the user releases the device 16 as it is placed within the groove.

At the rear, the arch/chin guard device 16 can be equipped with means for retaining the strap of goggles. These means are shown in FIGS. 6 and 7 as having the shape of a hook 22 which prevents the strap of the goggles from slipping upwards on the outer surface of the helmet.

For a helmet manufacturer, the cost to develop and manufacture a line of helmets including four helmets, corresponding to the helmets of FIGS. 1, 2, 3, and 6 and each of them provided for a specific sport and/or use, will be greatly reduced because the shell, the main component of these helmets, is identical.

For a user, the purchase of a single shell such as the one shown in FIG. 1, and a plurality of arch devices 7, 11, 16, the shell and devices together comprising a helmet assembly, will enable the user to use the same shell for a variety of uses and sports provided that the various arch devices 7, 11, 16 are releasably attached so as to enable the user to interchange them. Accordingly, for a low-risk sport practiced in a hot weather, the helmet can used without an arch device; for leisure skiing, the helmet can be used with a simple arch device 7, which guarantees the thermal protection of the ears; and for competitive skiing, the helmet can be used with the arch-ear device 11 or the arch/chin guard device 16.

Figure 8:
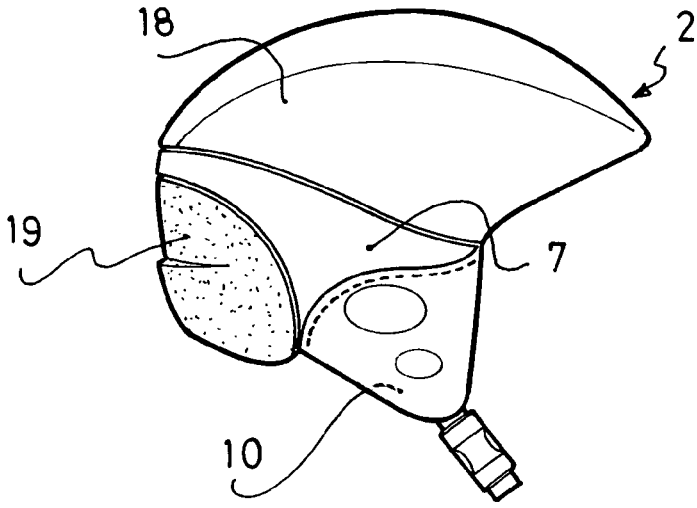
Figure 9:
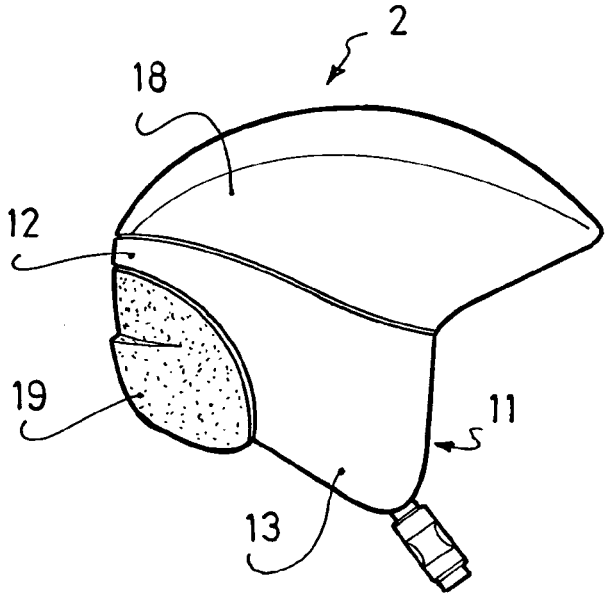
Figure 10:
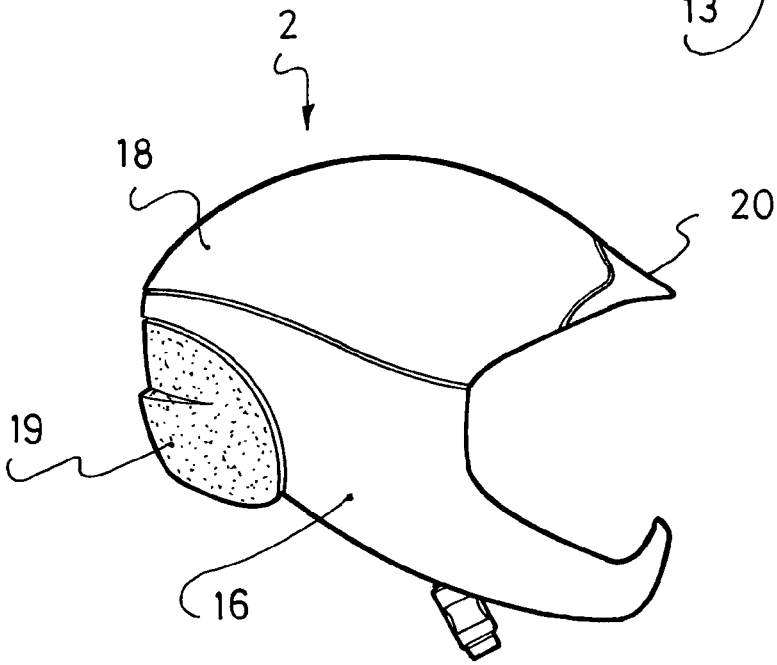

FIGS. 8, 9, and 10 illustrate a line of three helmets according to alternative embodiments of the invention. The shell 2 has a single piece made of expanded polystyrene, e.g., molded over two sheets of polycarbonate, for example. The first sheet 18 covers the top of the skull and is of a first color. The second sheet 19 covers the nape of the neck and is of a second color. The simple arch 7, at the ends of which the ear-covering parts 10 are attached, is positioned on the shell so as to cover the edge of each of the sheets 18 and 19 in the area of their separation, i.e., the arch 7 is nested within a groove between the sheets 18 and 19, i.e., by the edges of the arch 7 having the same contours as the edges of the sheets 18 and 19 with which the arch 7 is adjacent., Thus, the separation between the two colors is clear and precise insofar as it is obtained by the edges of headband portion 12.

FIG. 9 shows the helmet equipped with an arch-ear device 11. The device 11 includes a headband portion 12 similar to that of the single arch 7 of the helmet shown in FIG. 8, which is extended at both ends by wings 13. Ear-covering parts 10 having foam cushions are attached under the wings 13. The shell 2 has a first color above the headband portion 12 and a second color below it.

FIG. 10 shows a full helmet made from a shell identical to that of the helmets of FIGS. 8 and 9. In addition to the arch/chin guard 16, the shell 2 also receives a visor 20.

FIGS. 11, 12, and 13 illustrate a line of three helmets according to another alternative of embodiment of the invention. Without describing the details again, the helmets have a shell 2 made by the "in-mold" technology and an arch 7, 11, 16 made of a rigid material.

In FIG. 11, the single arch 7 includes a headband portion 12 which extends around the back of the helmet from one side to the other, means for attaching the ear-covering parts 10, and frontal extensions 21 which extend along the frontal edge of shell 2.

In FIG. 12, in addition to the headband portion 12, the frontal extensions 21 and the ear-covering parts 10, the arch-ear device 11 includes two wings 13 which are extensions of the headband portion made from the same material.

FIG. 13 illustrates a full helmet. The arch/chin guard device 16 includes a headband portion 12 fixed on the rear portion of the shell 2. At the extension of the headband portion 12, there are wings 13 on each side, then the chin guard 17 From each wing 13 and along the frontal edges of the shell 2, the frontal extensions 21 are positioned which join each other at the top of the frontal edges to form the visor 20. The ear-covering parts 10 are positioned under the wings 13. In addition, the chin guard 17 is also equipped with an internal comfort lining in the form of foam pads, possibly covered with fabric. Given the complexity of the arch-chin guard device 16, the invention contemplates making the device 16 in several parts which are assembled separately on the shell 2.

The invention is not limited to the particular details of the several embodiments described hereinabove, which have been presented by way of example.

GLOSSARY

1. helmet
2. shell
3. outer skin
4. groove
5. chin strap
6. vents
7. arch device
8. front chin strap
9. back chin strap
10. ear-covering part
11. arch-ear device
12. headband portion
13. wings
14. internal lining
15. expanded polystyrene cap
16. arch-chin guard device
17. chin guard
18. first sheet
9. second sheet
20. visor
21. frontal extension
22. hook
23. first layer of arch-ear device 11
24. second layer of arch-ear device 11
25. glue

What is claimed is:

1. A helmet for protecting the head of a user, said helmet comprising:
- a shell comprising:
  - a body;
  - an outer skin affixed to the body;
  - an outer surface comprising a groove;
- an arch device comprising:
  - a headband portion positioned on the shell by being nested within the groove of the shell;
  - the headband portion having two ends;
  - ear-covering parts connected to respective ones of the two ends of the headband portion of the arch device.

2. A helmet according to claim 1, wherein:
- the body of the shell comprises a foam material;
- the foam material is affixed to the outer skin of the shell by having been molded over the outer skin.

3. A helmet according to claim 2, wherein:
- the foam material comprises expanded polystyrene foam.

4. A helmet according to claim 1, wherein:
- each of the ear-covering parts comprises foam cushion covered by fabric.

5. A helmet according to claim 1, wherein:
the arch device comprises a wing extending each of the ends of the headband portion, each of the wings covering respective ones of the ear-covering parts.

6. A helmet according to claim 5, wherein:
the arch device further comprises a chin guard extending between and joining together the two wings.

7. A helmet according to claim 1, wherein:
the arch device further comprises extensions extending along a frontal edge of the helmet.

8. A helmet according to claim 7, wherein:
said extensions are joined together and form a visor.

9. A helmet according to claim 1, wherein:
the arch device is injection-molded.

10. A helmet according to claim 1, wherein:
the arch device comprises a plurality of layers of material.

11. A helmet according to claim 1, wherein:
the arch device comprises a plurality of layers of fiber glass or carbon fabric.

12. A helmet according to claim 1, wherein:
the arch device is affixed to the shell with a glue.

13. A helmet according to claim 1, wherein:
the arch device is releasably fitted to the shell.

14. A helmet according to claim 1, wherein:
the outer skin comprises two sheets having different colors.

15. A helmet according to claim 1, wherein:
the groove of the shell has lengthwise-extending opposed edges with respective contours;
the headband portion of the arch device having lengthwise-extending opposite edges having said contours of said opposed edges of the groove of the shell.

16. A helmet according to claim 1, wherein:
the headband portion of the arch device has a width equal to a width of the groove of the shell.

17. A helmet according to claim 1, wherein:
the headband portion of the arch device has a width equal to a width of the groove of the shell from one of the two ends to a second of the two ends.

18. A helmet according to claim 1, wherein:
the headband portion of the arch device extends downwardly and forwardly to each of the ear-covering parts.

19. A line of helmets for protecting the head of a user, said line of helmets comprising:
a plurality of helmets, ones of said plurality of helmets being adapted to a different sporting activity;
each of said plurality of helmets comprising a shell, the shell comprising a body and an outer skin affixed to the body, each shell of said plurality of helmets being identical and having an outer surface with a groove, said groove having lengthwise-extending opposed edges with respective contours;
each of said plurality of helmets further comprising an arch device comprising a headband portion having lengthwise-extending opposite edges, said headband portion being nested within the groove of an outer surface of the shell by means of said opposite edges of the headband portion having said contours of the opposed edges of said groove, the headband portion having two ends, the arch device further comprising ear-covering parts connected to respective ones of the two ends of the headband portion;
each of said ones of said plurality of helmets adapted to a different sporting activity within said line of helmets having a respective arch device having a different shape based upon said different sporting activities, respectively.

20. A line of helmets according to claim 19, wherein:
the arch device further comprises a wing extending from each of the ends of headband portion, the wings and the headband portion of the arch device constituting a single piece of rigid material.

21. A helmet assembly for protecting the head of a user, said helmet assembly comprising:
a single shell, said shell comprising a body and an outer skin affixed to the body;
an outer surface comprising a groove having lengthwise-extending opposed edges with respective contours;
a plurality of arch devices, ones of said plurality of arch devices having different shapes adapted for interchangeable use with said single shell during different sporting activities;
each of said plurality of arch devices comprising a headband portion having lengthwise-extending opposite edges, said headband portion being nested within the groove of an outer surface of the single shell by means of said opposite edges of the headband portion having said contours of the opposed edges of said groove, said headband portion being adapted to be releasably positioned on the single shell for facilitating replacement of one of said plurality of arch devices with another of said plurality of arch devices, the headband portion of each of said arch devices having two ends, each of said arch devices further comprising ear-covering parts connected to respective ones of the two ends of the headband portion.

22. A helmet assembly according to claim 21, wherein:
each of the headband portions of said plurality of arch devices further comprises a wing extending from each of the ends of headband portion, the wings and the headband portion constituting a single piece of rigid material.

23. A helmet for protecting the head of a user, said helmet comprising:
a rigid shell comprising:
a body;
an outer skin affixed to the body;
an outer surface comprising a groove;
a rigid arch device comprising;
a rigid headband portion positioned on the rigid shell by being nested within the groove of the rigid shell;
the rigid headband portion having two ends;
ear-covering parts connected to respective ones of the two ends of the rigid headband portion of the rigid arch device.

24. A helmet according to claim 23, wherein:
said body of the shell comprises a foam material;
the foam material is affixed to the outer skin of the shell by having been molded over the outer skin.

25. A helmet according to claim 24, wherein:
the foam material comprises expanded polystyrene foam.

26. A helmet according to claim 23, wherein:
the headband portion of the arch device extends downwardly and forwardly to each of the ear-covering parts.

27. A helmet for protecting the head of a user, said helmet comprising:
a rigid shell comprising:
a body;
an outer skin affixed to the body;
an outer surface comprising a groove having opposed edges extending along respective contours;
an arch device comprising:
a rigid headband portion having opposite edges, said rigid headband portion being nested within the groove of the rigid shell by said opposite edges of said rigid headband portion having the same contours as respective ones of said opposed edges of said groove;

the headband portion having two ends;

ear-covering parts connected to respective ones of the two ends of the rigid headband portion of the arch device.

* * * * *